United States Patent [19]

Becelaere

[11] 4,432,272

[45] Feb. 21, 1984

[54] MOTOR OPERATED FIRE DAMPER

[75] Inventor: Robert M. Van Becelaere, Prairie Village, Kans.

[73] Assignee: Ruskin Manufacturing Company, Grandview, Mo.

[21] Appl. No.: 444,836

[22] Filed: Nov. 29, 1982

[51] Int. Cl.[3] ..... F24F 7/00

[52] U.S. Cl. ..... 98/1; 236/49

[58] Field of Search ..... 236/49, 1 G; 98/1 R; 251/132; 169/161

[56] References Cited

U.S. PATENT DOCUMENTS 4,039,123 8/1975 Frankel ..... 236/1 G

FOREIGN PATENT DOCUMENTS 964682 3/1975 Canada ..... 98/1 R

*Primary Examiner*—William E. Wayner

*Attorney, Agent, or Firm*—Kokjer, Kircher, Bradley, Wharton, Bowman & Johnson

[57] ABSTRACT

A fire and smoke damper having an electric motor coupled with the damper to hold the damper blades open when the motor is energized. A spring associated with the motor provides torque for closing the blades when the supply of electrical energy to the motor is interrupted. A thermal responsive electrical switch is mounted on the damper and incorporated in the electric circuit which supplies energy to the motor so that the motor is de-energized and the damper is closed when the ambient temperature reaches a predetermined level.

5 Claims, 4 Drawing Figures

Fig. 1.
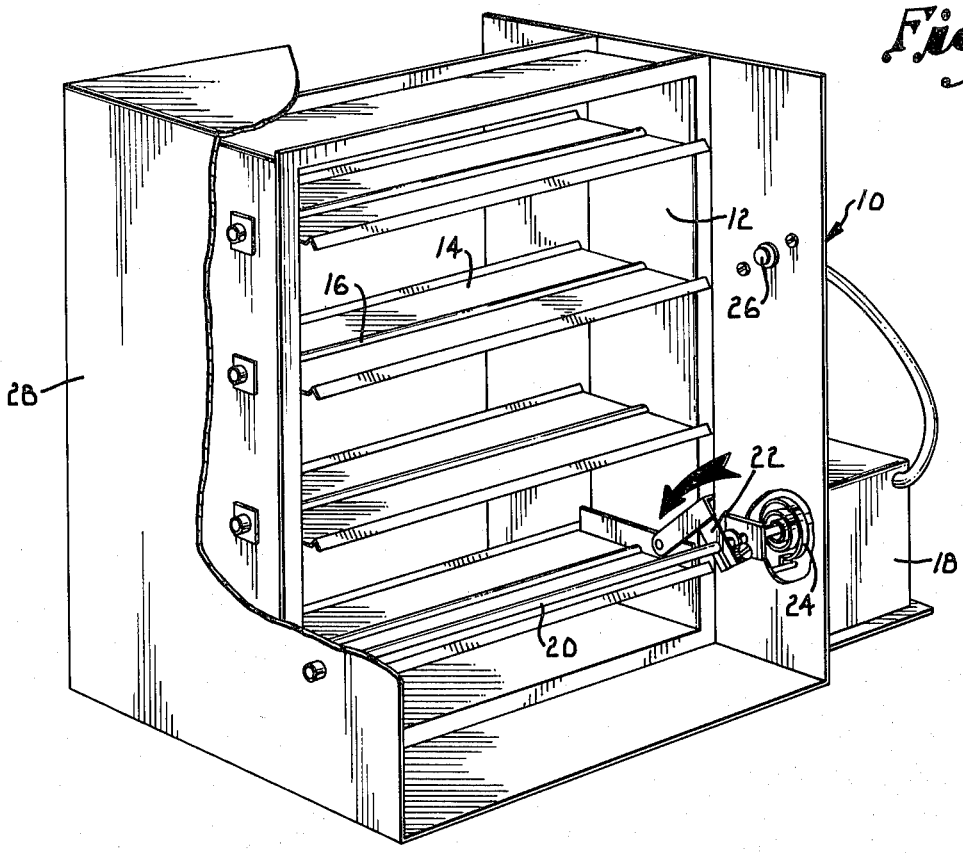
Fig. 2.
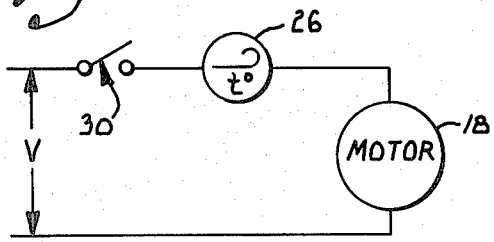
Fig. 3.
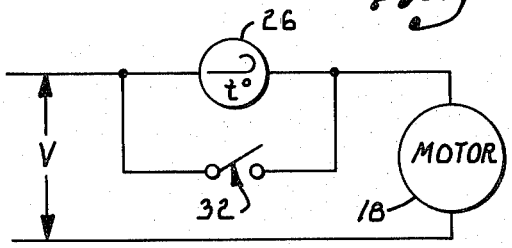
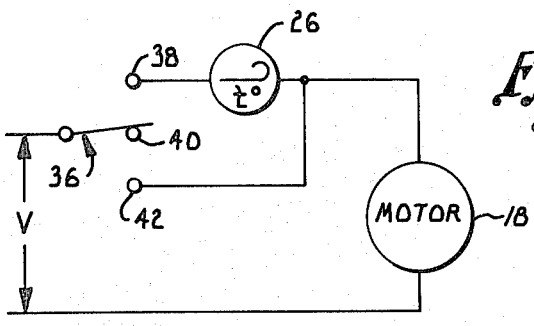
Fig. 4.

MOTOR OPERATED FIRE DAMPER

This invention pertains to ventilation control devices, and more particularly to a fire or smoke damper for use in protecting the ventilation conduits of a building. Most buildings are subject to certain codes promulgated by appropriate governmental bodies which require that duct work and various communication channels in a building be protected with barriers which close off the duct or channel at strategic locations in case of ifre. These barriers help to prevent the spread of the fire through the building and also serve to prevent distribution of toxic smoke and fumes throughout the building through the ventilation system.

Typically fire and smoke dampers comprise frame mounted closures which may be interposed directly into the passages and conduits of the building. The closure is usually biased toward the flow blocking or closed position by one or more springs and is held in the standby or open position by a retainer incorporating a fusible link. Such links comprise a pair of separable elements interconnected with a eutectic solder which melts to permit the elements to separate when the ambient temperature reaches a predetermined level. The critical temperature is reached and exceeded at the onset of a fire proximal the damper and separation of the link elements permits the closure to be automatically moved to its closed position by the damper springs.

While devices of this type have served exceedingly well for fire protection purposes, they depend upon the elevation of the temperature to the critical value in the immediate vicinity of the damper before the link separates to permit the damper to actuate. Many modern buildings are constructed with highly efficient ventilation systems which rapidly circulate the air throughout the building. In some cases such systems have distributed toxic smoke and fumes from a smoldering fire throughout an entire building without the fire having elevated the temperature sufficiently to actuate the fusible link controlled fire dampers. In other cases, such smoke and fumes have entered the ventilation system before the control devices adjacent the fire have been activated from the heat of the fire. Even though the adjacent devices have subsequently operated to isolate the fire to the immediate vicinity where it began, the temperature at other sections of the building has not been sufficient to melt the links of the protective devices and halt the distribution of the toxic smoke and fumes throughout the entire building. Further, in some cases where the smoke filled air does have sufficient heat to melt the fusible links, it may be desirable to re-open certain dampers so that the toxic fumes may be drawn by the system out of areas of the building not subject to immediate danger of combustion from the fire.

Accordingly, a need has arisen for a motor operated damper which may be selectively re-opened to permit the passage of fluid once it has been operated. Although motor operated dampers have been suggested in the past, they generally have been found unacceptable or have not passed appropriate industry standard tests because they have been dependent upon the availability of electrical energy or the loss of such energy by destruction of electrical wires by fire for their primary fire protection function. A fire can interrupt the supply of such energy or may not interrupt the supply in all cases and the consequences from such uncertainty has retarded the use of heretofore available motor operated fire dampers.

It is, therefore, a primary object of the present invention to provide a damper which is operable with an electric motor for selectively opening the damper to vent smoke and fumes, yet which retains the capability of functioning in its primarily fire protection role even if the supply of electrical energy to the motor should be interrupted.

Another important object of the invention is to provide such a damper which is highly reliable and which is capable of operation after long periods of standby service.

Another object of the invention is to provide a damper which will immediately operate to close of fluid communication through the damper when the ambient temperature is elevated to a predetermined critical level, even if the electrical circuitry to the damper is not damaged by a fire yet which may be quickly and easily returned to its standby condition after the fire is extinguished.

These and other important aims and objectives of the invention will be further explained or will become apparent from the following explanation and description of the drawing, wherein:

FIG. 1 is a front perspective view of a damper embodying the principles of this invention, parts being broken away to reveal details of construction;

FIG. 2 is a schematic drawing of one form of control circuit for the damper of FIG. 1;

FIG. 3 is a schematic drawing of another control circuit therefor; and

FIG. 4 is a schematic drawing of yet another control circuit therefor.

A damper embodying the principles of this invention is broadly designated in the drawing by the reference numeral 10. Damper 10 may be of any suitable construction capable of installation in a building fluid passagage such as an air conditioning or heating duct or the like for the purpose of closing off the duct in case of fire. In the embodiment chosen for illustration, damper 10 comprises a peripheral frame 12 having a plurality of generally rectangular blades 14 mounted for pivotal movement between generally horizontal positions as shown in the drawing and vertical blade positions wherein the blades overlap to close off the damper opening. Axles 16 extend longitudinally of the blades and transversely across the damper opening. The axles 16 are interconnected with linkage (not shown) whereby the rotation of one blade about its axle causes simultaneous rotation of the other blades so that the blades may be opened or closed together as a unit. An actuating motor 18 has an output shaft 20 coupled by linkage 22 with one of the blades 14 so that rotation of shaft 20 by the motor rotates all of the units about their respective shafts 16. Motor 18 is constructed with an internal torsion spring 24 which biases shaft 20 in a direction to close the damper blades when the motor is not energized. Conversely, when electrical energy is connected with the motor, the latter turns the shaft against the biasing force of spring 24 to rotate the damper blades to their open positions.

A thermal responsive switch 26 is electrically connected with motor 18 and the source of electrical energy thereto. Switch 26 is of a type capable of operating responsive to the elevation of the ambient temperature above a predetermined amount. Switches found suitable for this purpose may comprise those having a bimetallic actuator capable of deforming in response to temperature elevation to interrupt the flow of electrical energy. Switches of this type are commercially available and one found suitable for the purpose is manufactured by Control Products Div., Texas Instruments, Inc., 30 Forest Street, Attleboro, Mass., and sold commercially under the tradename KLIXON.

Damper 10 is installed in a building fluid passage at a critical location such as at a fire wall. The damper is constructed with a peripherally extending collar secured to frame 12 and adapted to be mated with the building fluid ducting, preferably during the construction of the building. Often dampers of this type must be installed in remote and relatively inaccessible locations. The damper is connected with a source of electrical energy when it is installed and motor 18 is of a type which rotates shaft 20 in the direction to maintain the damper blades in their opened position. Spring 24 is capable of exerting sufficient torque on shaft 20 to rotate the latter in the direction of the arrow in FIG. 1 to close the damper blades immediately upon the cessation of the flow of electrical energy to motor 18.

In the event of a fire in the building sufficient to raise the ambient temperature beyond the threshold parameter for operating switch 26, the latter opens to interrupt the flow of electrical energy to the motor. This results in substantially instantaneous closing of the damper blades and the isolation of the passage from further flow of super heated air or toxic combustion gases from the fire.

FIG. 2 shows schematically a simplified electrical circuit suitable for the operation heretofore described. In this case, a manual switch 30 is interposed in the circuit. Switch 30 would normally be closed so that the motor would remain energized until the ambient temperature became elevated from a fire. Switch 30 could be opened manually if it ever became desirable to close the fluid passage for any reason even though the ambient temperature at the damper location had not reached a level sufficient for operating switch 26. The decision to close the damper could occur, for example, in the event that a fire broke out in some remote location of the building and it was desired to close the passage to prevent smoke and noxious fumes from migrating through a building ducting system.

FIG. 3 shows another simplified schematic similar to FIG. 2 but with manual switch 32 connected in parallel with switch 26. This arrangement would have the benefit of permitting selective closing or opening of the damper blades by the operator even in the event that a fire would occur sufficiently close to the damper to cause the opening of switch 26. In other words, if the ambient temperature proximal the damper were sufficiently high to open switch 26 but if motor 18 and the circuitry were not damaged beyond operability, switch 32 could be closed to open the damper for selectively venting of smoke and the like through the ventilation system.

FIG. 4 shows a control set up wherein manual switch 36 is a three position switch permitting the switch pole piece to be engaged with contact 38 to provide the normal standby operation of the damper with the damper blades held open by energized motor 18. If, for any reason, it would be desired to close the damper blades, the pole piece of the switch could be moved to contact 40 terminating electrical energy flow to the motor and permitting the blades to close under the torque provided by the spring. Further, if it were desired to reopen the damper and if the ambient temperature was sufficiently high to cause the opening of switch 26, the pole piece would be moved to contact 42 to reenergize the motor and open the damper blades.

A wide variety of other combinations could be selected for controlling the damper of this invention. However, the foregoing illustrate the advantages of a motor operated damper to permit selective opening or closing of the damper from remote locations. The opening or closing operation may become critically necessary in the case of fire. It is not always desired that the damper be closed at this time because it may be required that the damper be open to vent the building of noxious fumes and smoke or the like. It remains a condition for protective devices of this type that they be capable of automatic and instantaneous operation to close off building passages at critical junctures in case of fire. The combination of the thermal responsive control switch with an electric motor and a spring closing feature greatly enhances the versitility of use for protective devices of this kind.

I claim:

1. A protective damper for controlling the flow of fluid through a ventilation conduit for a building, said damper comprising:

a frame adapted to be mounted in said conduit;

a barrier carried by the frame and movable between an open position permitting fluid flow through the damper, and a closed position blocking said flow;

spring means operably coupled with the barrier biasing the latter into said closed position;

electric motor means operably coupled with the barrier and adapted to be coupled with a source of power for moving the barrier to said open position against the bias of said spring means when the motor is energized, thermal responsive switch means mounted on the frame and exposed to the fluid flowing therethrough, said switch means being operably coupled with the motor means to permit the latter to remain energized to hold the barrier in said flow permitting position when the ambient temperature at the switch is below a predetermined level and to deenergize the motor to permit the barrier to be moved to said flow blocking position when the ambient temperature at the switch is elevated to said predetermined level; and an overriding switch operably coupled with the motor means and adapted to be coupled with said power source, whereby to permit optional energizing of the motor to open the barrier irrespective of operation of the thermal responsive switch to deenergize the motor.

2. The invention of claim 1, wherein said barrier comprises a plurality of interconnected blades, and means coupling said blades to said motor.

3. The invention of claim 1, wherein said switch means includes a bi-metallic switch element capable of deforming to open the switch responsive to the elevation of the ambient temperature above a predetermined level.

4. The invention of claim 1, wherein said overriding switch is electrically connected in series with said thermal responsive switch, whereby said thermal responsive switch is capable of insuring that the damper is closed upon elevation of the ambient temperature to said predetermined level, irrespective of the position of said overriding switch.

5. The invention of claim 1, wherein said overriding switch is electrically connected in parallel with said thermal responsive switch, whereby to permit selective energizing of the motor to open the damper after said thermal responsive switch has been opened by elevation of the ambient temperature.

* * * * *